United States Patent [19]

Overton

[11] Patent Number: 4,701,963

[45] Date of Patent: Oct. 27, 1987

[54] GLOVE

[76] Inventor: V. Parker Overton, 111 Red Banks Rd., Greenville, N.C. 27834

[21] Appl. No.: 17,744

[22] Filed: Feb. 24, 1987

[51] Int. Cl.[4] ..... A41D 19/00

[52] U.S. Cl. ..... 2/161 A; 2/167

[58] Field of Search ..... 2/161 A, 161 R, 159, 2/163, 167

[56] References Cited

U.S. PATENT DOCUMENTS

| | | | |
|---|---|---|---|
| 2,456,678 | 12/1948 | Cole | 2/161 A X |
| 2,554,991 | 5/1951 | Kramer | 2/159 |
| 3,582,992 | 6/1971 | Gold | 2/161 A X |
| 3,790,168 | 2/1974 | Hashimoto | 2/161 A X |
| 3,952,333 | 4/1976 | Fujita | 2/161 A |
| 4,183,100 | 1/1980 | De Marco | 2/159 |
| 4,519,097 | 5/1985 | Chappell, Jr. et al. | 2/159 X |
| 4,561,122 | 12/1985 | Stanley et al. | 2/161 A X |
| 4,574,398 | 3/1986 | Endo et al. | 2/159 |
| 4,658,445 | 4/1987 | Tribble | 2/161 A |

*Primary Examiner*—H. Hampton Hunter

*Attorney, Agent, or Firm*—Mills & Coats

[57] ABSTRACT

The present invention entails a glove having a padded palm which includes a series of parallel padded ridges that extend across the palm area of the glove at an angle. Moroever, the glove is provided with dual attaching straps. One strap, a wrist attaching strap, draws the glove snugly around the subject's wrist. The other strap, a back side strap, when secured extends at an angle across streetchable material forming a portion of the back side of the glove. Effectively, the back angled strap tends to pull and gather the back side of the glove resulting in a snug and secure fit about the subject's hand.

13 Claims, 8 Drawing Figures

GLOVE

BACKGROUND OF THE INVENTION

In recent years sport gloves of all types have been developed. They are presently widely used by football players, baseball players and other individuals participating in athletic events. For a review of some basic design in gloves and particularly in sports gloves one is referred to the disclosures found in the following U.S. Pat. Nos.:

| | | | |
|---|---|---|---|
| Steinberger | 2,157,836 | Lindfelt | 2,309,516 |
| Lindfelt | 2,314,545 | Cole | 2,456,678 |
| Kramer | 2,554,991 | Weinberg | 3,175,226 |
| Gold | 3,582,992 | Stanton | 3,597,765 |
| Fujita | 3,952,333 | Swanson | 4,000,903 |
| De Marco | 4,183,100 | Chappell, Jr. et al | 4,519,097 |
| Berger | 4,531,241 | Endo et al | 4,574,398 |

But sports gloves of the past and those commercially available today have their drawbacks. Among the disadvantages found in commercially available sports gloves is that they are bulky and loose fitting. Beyond that they are not always designed properly for their intended use. Expressed in another way, these gloves are not particularly designed for a particular sport and the work that has to be done by an athlete in a particular sport. For example, in the case of a water skier, there is substantial load applied to the skier's fingers that encircle a water ski handle. There is a need for a glove that relieves the load from the fingers and transfers load to the palm area of the water skier's hands.

In addition, there has been and continues to be a need for designing a sports glove that is effectively skin tight and which as noted above is not bulky or cumbersome. Since the glove is going to be an extension of the user's hand it is desirable that it fit snugly and tightly about the user's hand in a comfortable manner. This clearly gives the user better "feel" and in turn enables the user to experience better control over the structure being handled. In addition, it is desirable that the glove be highly pliable and flexible to enable the user to manipulate his or her fingers to almost the same degree that he or she can without the glove.

Therefore, there is and continues to be a need for a sports glove that is particularly designed in the palm area to assist the user in carrying loads and which is also designed to fit relatively tightly and snugly around the user's hand.

SUMMARY AND OBJECTS OF THE INVENTION

The present invention entails a sports glove that is designed to overcome the drawbacks and shortcomings of gloves known and used in the past. In particular, the glove of the present invention includes a padded palm area that is designed to transfer the load of an object, such as a ski rope handle, to the palm of the user's hand as opposed to a substantial portion of the force or load being directed against the user's fingers.

In addition, the glove of the present invention includes a dual strap attaching assembly for securely drawing the glove around the user's wrist and at the same time including a backside strap that is designed, in the attached position, to extend at an angle over the back of the hand so as to draw and gather the glove against the user's hand so as to create a snug and relatively tight fit.

It is therefore an object of the present invention to provide a versatile glove that can be used in a variety of sports and for a variety of purposes.

Another object of the present invention resides in the provision of a glove that includes a padded palm overlay that is designed to engage a work object such as a ski rope handle, baseball bat or the like.

Still a further object of the present invention resides in the provision of a glove with a padded overlay that is designed to include a series of angled ridges that extend across the palm area of the glove at a slight angle to the axis of the middle finger.

A further object of the present invention resides in the provision of a padded palm structure that includes a series of indented seamlines that extend at a slight angle upwardly from the little finger towards the index finger and wherein the respective indented seams form a series of parallel padded ridges.

Still a further object of the present invention resides in the provision of a glove with a dual strap attaching assembly, one strap designed to secure the glove about the user's wrist while the other strap is designed to secure the glove about the backside of the user's hand.

Still a further object of the present invention resides in the provision of a glove of the character referred to above wherein the backside attaching strap is, in the secured and attached position, disposed at an angle with respect to the middle finger such that it lies over a substantial area along the back of the user's hand and as such tends to gather and draw the backside of the glove together to form a snug and secure fit about the user's hand.

It is also an object of the present invention to provide a glove of the character referred to above that is relatively simple in design and which is easy to manufacture.

It is also an object of the present invention to provide a sports glove of the character referred to above that is designed to fit relatively snugly about the user's hand and which includes an attaching structure that securely holds the glove about the user's hand.

Other objects and advantages of the present invention will become apparent and obvious from a study of the following description and the accompanying drawings which are merely illustrative of such invention.

DETAILED DESCRIPTION OF THE INVENTION

Figure 1:
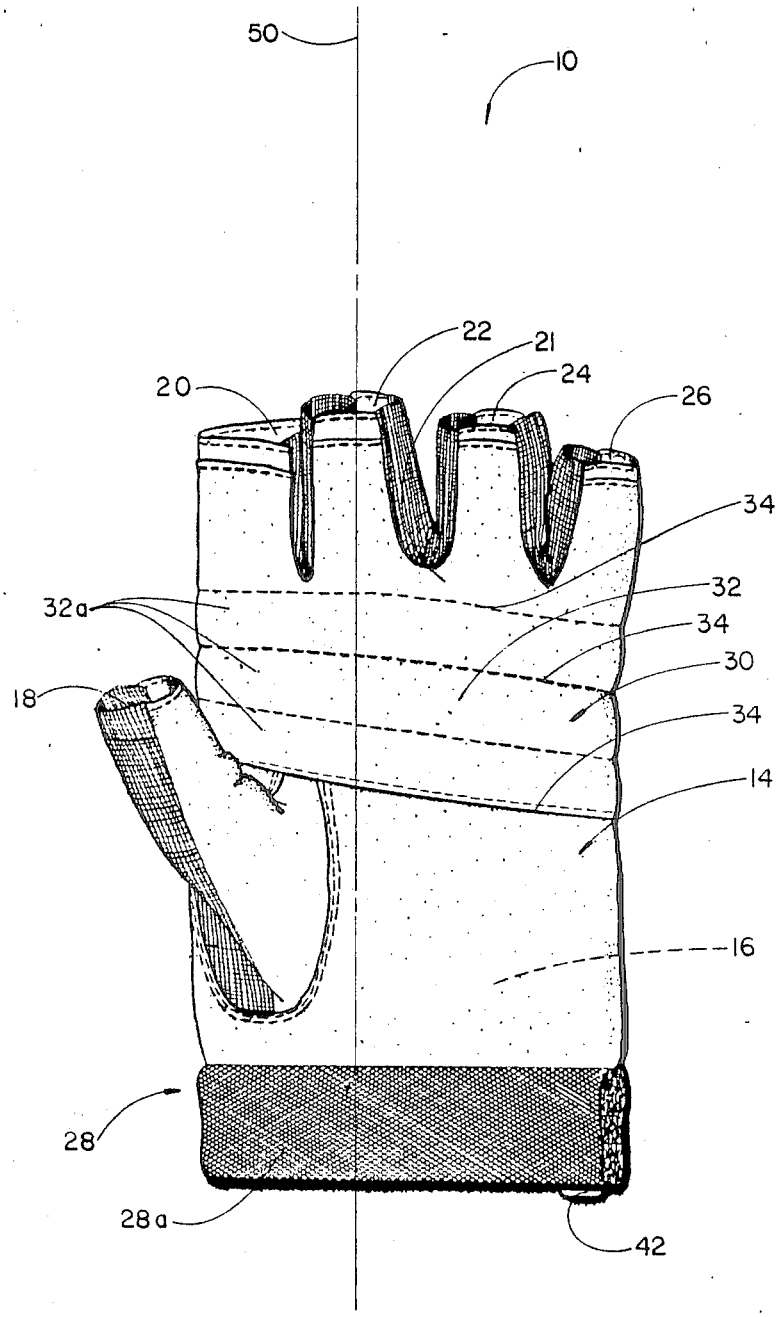
FIG. 1 is a top plan view of the palm side of the glove of the present invention.

With further reference to the drawings, the glove of the present invention is shown therein and indicated generally by the numeral 10. Glove 10 includes a palm side 12 and a backside 14 stitched together so as to form an internal hand receiving area 16. While glove 10 can be constructed of various types of material, the present disclosure contemplates that the glove, 10 would be constructed from a synthetic type material and a stretchable type material such as nylon. In the drawings the stretchable, nylon type material appears as an insert in the backside 12 and also extends along segmented portions of the fingers. In the drawings this material is indicated as a mesh material.

Formed about the upper end of glove 10 is a series of thumb and finger openings. As indicated in the drawing there is provided a thumb opening 18, an index finger opening 20, a middle finger opening 22, a third finger opening 24, and a little finger opening 26. The area just below the finger openings is referred to as the finger opening base area 21.

About the opposite end of the glove 10 is a wrist surrounding area indicated generally by the numeral 28. As shown in the drawings glove 10 is provided with a surrounding wrist cuff **28*a***.

Figure 2:
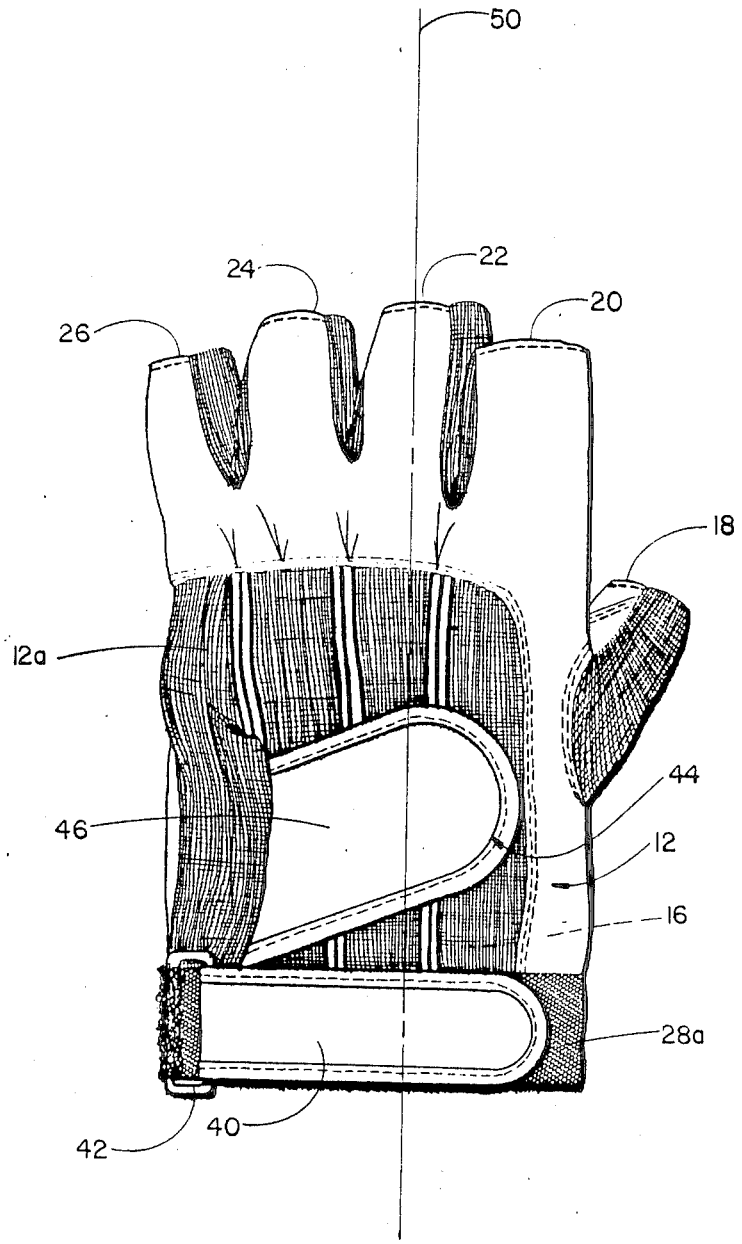
FIG. 2 is a plan view of the backside of the glove showing dual straps in a secured position.

The expandable nylon type material referred to above and used in the construction of the glove is formed into an insert **12*a* that forms a part of the backside 12 of the glove 10. Note that the expandable or stretchable insert 12*a* extends from the wrist cuff 28*a* upwardly toward the plurality of finger openings and is spaced just inwardly of the thumb opening 18, as best seen in FIG. 2. This, as will be appreciated from subsequent portions of this disclosure, allows the backside 12** of the glove to be tightened and gathered about the user's hand to form a very snug and relatively tight fit.

Figure 4:
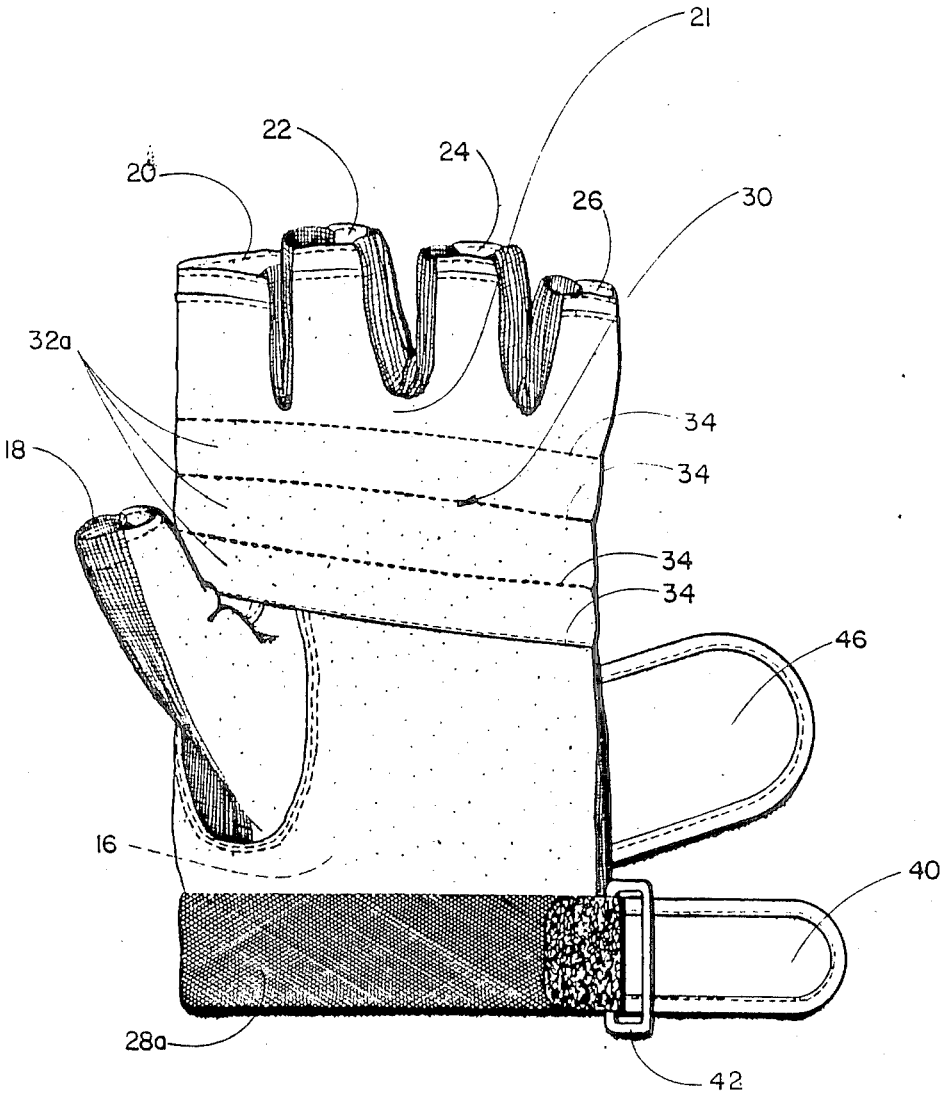
FIG. 4 is also a plan view of the palm side of the glove with dual straps extending outwardly in an unattached position.
Figure 5:
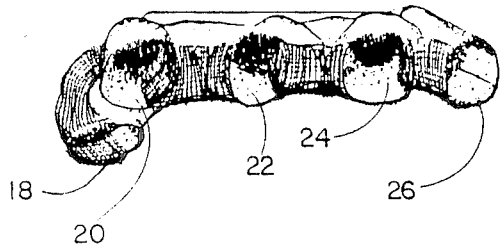
FIG. 5 is a front or a top edge elevational view of the glove as viewed from the top of FIG. 1.
Figure 6:
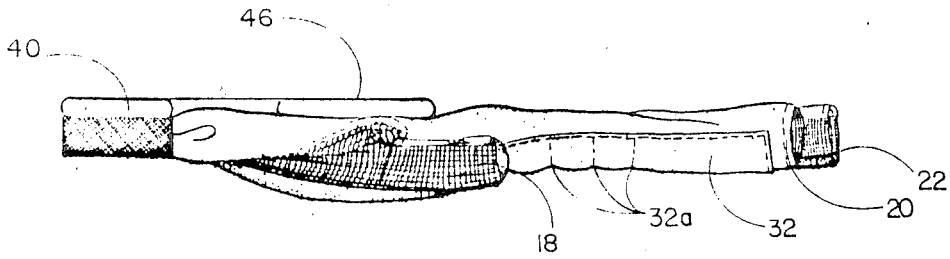
FIG. 6 is a side edge elevational view of the glove of the present invention as viewed from the left side of FIG. 1.
Figure 7:
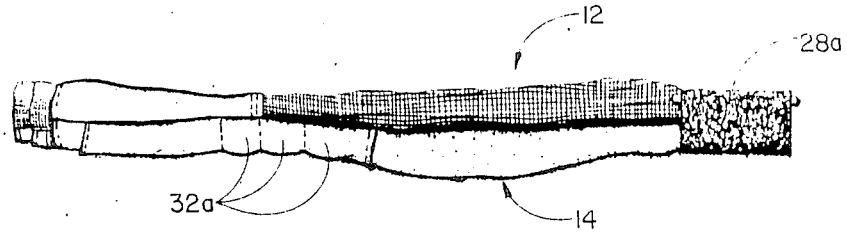
FIG. 7 is a side edge elevational view of the glove of the present invention as viewed from the right side of FIG. 1.
Figure 8:
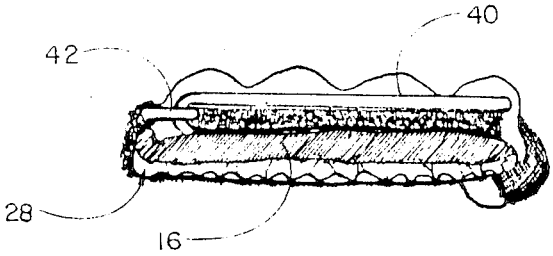
FIG. 8 is a bottom edge view of the glove as viewed from the bottom of FIG. 1.

Turning to the palm side 14 of the glove 10 it is seen that the same is provided with a padded palm overlay indicated generally by the numeral 30. The padded palm overlay includes a palm overlay panel 32 that is actually secured onto the palm side 14 of the glove. As seen in FIGS. 1 and 4, there is provided a plurality of indented seams 34 that extend parallel to each other. Seams 34 define a series of side by side extending ridges **32*a* that extend above the respective seams 34. Interposed between the palm panel overlay 32 and the palm side 14** of the glove is soft resilient padding material such as closed cell neoprene.

Ridges **32*a* run at an angle across the palm area of the glove. In particular, the ridges 32*a* extend at an angle slightly upwardly from the little finger opening 26 towards the index finger opening 20. For the sake of reference, a middle finger axis line 50 is shown in the drawings. It is appreciated that the ridges 32*a*** extend across this imaginery reference line at an angle.

Integrally incorporated into the backside 12 of glove 10 is a dual strap attaching structure. Viewing this in detail it is seen, in FIG. 3, that the backside 12 of glove 10 is provided with a slit indicated generally by numeral 36. Slit 36 includes a pair of opposed edges **36*a* and 36*b* that meet to form a terminal closed or apex end 36*c*. Slit 36 extends from the closed terminal and 36*c* towards the base or lower end of the glove 10 and, in fact, extends completely through the wrist cuff 28*a* so as to allow the base or lower portion of the glove 10** to be easily opened for conveniently inserting one's hand into the glove.

Figure 3:
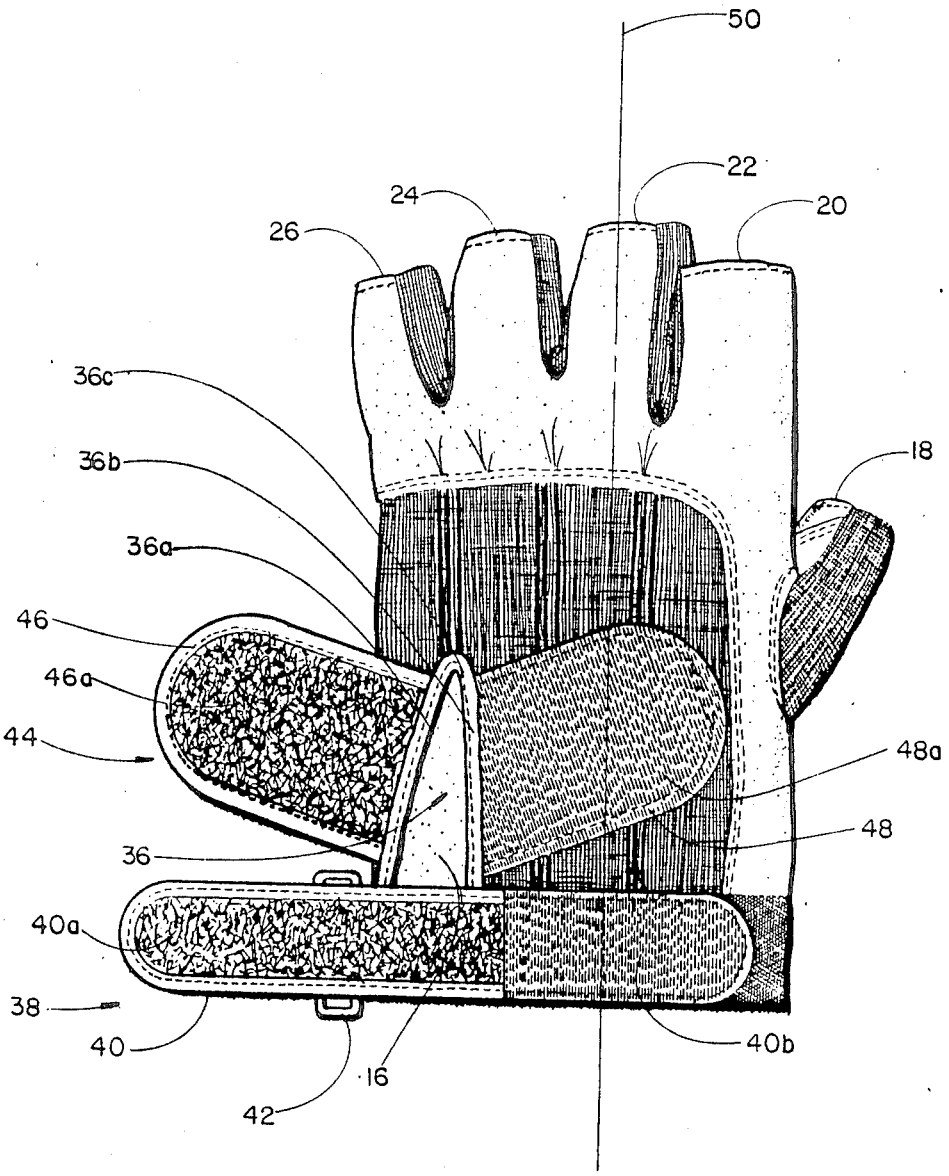
FIG. 3 is a plan view of the backside of the glove showing dual straps in an unattached position.

Continuing to refer to the dual strap attaching structure, first reference is made to a wrist strap attaching means indicated generally by the numeral 38. Wrist strap attaching means includes a wrist strap 40 that is secured to the wrist cuff 28 about the backside 12 of the glove, as particularly shown in FIGS. 2 and 3. As shown in FIG. 3, wrist strap 40 includes an exterior side that is provided with attaching means formed about opposite end portions. This attaching means assumes the form of a "Velcro" type attaching structure. In particularly, there is provided one set of "Velcro" type attaching means about end portion **40*a* and another set of "Velcro" type attaching means about opposite end portion 40*b*. These two sets of attaching means are designed to mate together to form a secure and tight fit. It is appreciated that the wrist strap 40 is attached to the right edge 36*b* of the slit 36, as viewed in FIG. 3. Secured to the opposite edge 36*a* is a loop connector 42**.

To secure the wrist strap attaching means 38, the terminal end of strap 40 is threaded through loop connector 42 and pulled therethrough to a point after which it is folded back to where end portion **40*a* is pressed into attaching engagement with the other end portion 40*b*, thereby securing glove 10 about the user's wrist. Because of the nature of the attaching structure provided with strap 40** it is appreciated that the same can be adjustably secured to various size wrists.

Continuing to refer to the dual strap attaching means, the second strap attaching structure comprising an angled backside attaching means indicated generally by the numeral 44. Angled backside attaching means 44 is completely independent from the wrist strap attaching means 38 just described.

This structure includes an angled strap 46 secured to edge **36*a* of slit 36. Note that the inside surface area of that strap, that side shown in FIG. 3**, includes "Velcro" type attaching means.

Secured about the opposite side of slit 36 is an attaching pad or tab 48 that includes an outer exposed surface of mating "Velcro" type attaching means **48*a*. Note in FIG. 3 that attaching tab 48 is secured to the backside 12 at an angle. In fact, note the orientation of attaching tab 48 with respect to reference line 50 which represents the longitudinal axis of the middle finger opening 22**.

When glove 10 is in a fitted or secured position it is appreciated that the backside attaching strap 46 extends at an angle over the backside of the user's hand. Again, as illustrated in FIG. 3, note that the backside attaching strap 46 extends upwardly from the lower base of the glove towards the thumb opening 18 and in fact extends at an angle to the middle finger axis reference line 50.

Effectively, backstrap 56 is used to draw and tighten the backside 12 of the glove 10. Because of the presence of the expandable or stretchable insert panel **12*a* formed about the backside of the glove 10 it is appreciated that the backside attaching strap 46** can be used to pull and gather this material overlying the backside user's hand such that a tight and snug fit can be achieved.

Because the backside attaching strap 46 extends at an angle it is appreciated that greater attaching surface area is made available while at the same time this approach enables the attaching structure to pull across the top of the user's hand and by doing so enables a very tight and snug fit to be achieved.

The dual strap attaching structure described permits the glove 10 to be fitted very closely to various size hands and enables the glove to be snugly secured the hand for better feel and control over the elements being handled.

In the case of the padded palm overlay, indicated generally by the numeral 32, this feature allows for a workpiece such as a ski rope handle to be firmly held within the skier's palm. Effectively this relieves the fingers of the requirement of carrying all of the load and allows the load or force to be transferred to the palm area of the hand. The angle of the respective ridges 32*a* helps to grip the workpiece involved and helps align the ski rope handle or other workpiece so as to take advantage of the natural hand strength areas. In addition, this allows the glove to pull evenly when a force is being applied thereto such as through a ski rope handle. In addition to improving the grip on the ski rope handle this padded palm design imparts less skin fatigue and helps distributes the weight and load over the hand.

From the foregoing specification and discussion, it is appreciated that the present invention presents a new and useful glove that is particularly useful by athletes and is especially suited for use by water skiers.

The present invention may, of course, be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A sports glove comprising: a palm and back side secured together to form a hand receiving opening having a series of thumb and finger openings including an index, middle and little finger openings and wherein the palm and back side include a wrist cuff area opposite the thumb and finger openings that extends around a subject's wrist when the glove is worn; a padded palm overlay secured to the palm side adjacent the thumb and finger openings and including a series of side by side transversely extending ridges that extend in general parallel relationship to each other and which are angled across the palm area of a subject's hand so as to generally extend at least slightly upwardly from the fourth finger opening toward the index finger opening; a dual strap assembly associated with said glove for securing the glove onto a subject's hand; said dual strap attaching assembly including an elongated slit formed in the wrist cuff area and extending through the back side of the glove toward the finger openings and having a terminating point situated intermediately between the finger openings and the wrist cuff; said dual strap attaching assembly including a wrist strap secured to one side of the slit and cooperating wrist strap securing means for securing the wrist strap to the glove; said dual strap attaching assembly further including an angled attaching strap secured about the back panel of the glove independently of the wrist strap and disposed between the wrist strap assembly and the finger openings for further securing the glove about the subject's hand; and wherein said angled attaching strap is secured on one side of the slit and wherein there is provided an angled strap securing means disposed on the opposite side of the slit for securing the angled attaching strap to the back side such that when secured the angled strap extends across the back of the subject's hand at an angle to a longitudinal centerline of the middle finger opening.

2. The glove of claim 1 wherein said wrist strap securing means includes a loop and wherein in a fitted mode the wrist strap extends through the loop and folds back over the same and wherein the securing means secures the wrist strap to the backside of the glove.

3. The glove of claim 2 wherein said wrist strap is elongated and wherein said securing means includes a hook and loop type attaching structure with the loops thereof being disposed on one end of the wrist strap and the hooks being disposed on the other end.

4. The glove of claim 3 wherein said slit is offset to one side of said backside of the glove and includes an outer disposed edge and an intermediate edge; and wherein said angled strap is attached adjacent the outer edge of the slit and wherein in a fitted mode extends over the slit at an angle and attaches with said angled strap attaching means such that the angled strap lies flat adjacent the backside of the glove and lies at an angle to the middle finger opening.

5. The glove of claim 4 wherein said wrist strap is attached adjacent the intermediate edge of the slit such that the angled attaching strap and wrist strap are attached on opposite sides of the slit so as to result in a cross pulling action when both straps are secured across the slit..

6. A glove with dual securing straps comprising: a hand glove having a palm side and a backside that forms a hand receiving area and a lower wrist surrounding area that in turn forms a hand insert opening; an elongated slit formed in the back side of the glove and extending from an intermediate point on the backside through the wrist surrounding area; dual strap attaching means for (1) securing the glove about the wrist of a subject by drawing the wrist surrounding area relatively tight around the wrist of the subject's hand and (2) tightening the backside of the glove across the backside of the subject's hand; said dual strap attaching means including an independent wrist strap secured to the wrist surrounding area adjacent one side of the slit and wrist strap attaching means including a connector secured across from the wrist strap on the opposite of the slit and wherein the wrist strap and wrist strap attaching means function to draw the wrist surrounding area of the glove relatively tight around the subject's wrist; said dual strap attaching means further including an angled back attaching strap spaced from the wrist strap and independent thereof and secured to one side of the slit and in a fitted mode extending over the slit at an angle and secured to the back side of the glove by angled strap attaching means; and said angled attaching strap and said angled strap attaching means functioning to laterally pull the backside of the glove together and in the process to secure the glove firmly and relatively tightly around the subject's hand.

7. The glove of claim 6 wherein said wrist strap and said angled strap are secured on opposite sides of the slit to yield a cross pulling action.

8. The glove of claim 7 wherein said slit is off-set to one side of said backside of the glove and wherein the angled strap is secured about an outer side area of the backside and extends therefrom over the slit at an angle and is directed upwardly away from the wrist surrounding area.

9. A glove with a series of angled, padded palm ridges, comprising: a glove having a backside, a palm side, a thumb opening, a palm area, and a series of finger openings including little and index finger openings extending from the palm area, and a finger opening base area formed along an area where the finger openings emerge and extend from the palm area; a padded palm overlay secured to the palm area of the glove and comprising a series of angled, padded, ridge overlays secured to the palm area between the thumb opening and the finger opening base area; said series of angled, padded, ridge overlays being disposed in side by side relationship and extending in general parallel relationship and angled to extend from below the little finger opening upwardly at an angle towards the index finger opening; and wherein said padded ridge overlays includes a series of indented seamlines that effectively form the parallel and angled ridges and wherein there is provided padded material between the ridge overlay and the palm area of the glove.

10. The glove of claim 9 wherein the padded material includes closed cell neoprene.

11. The glove of claim 9 wherein the angled padded ridges extend completely across the palm side of the glove.

12. The glove of claim 9 further comprising dual strap attaching means including wrist strap attaching means for drawing the glove relatively tight about a subject's wrist, and an angled back strap attaching means, independent of the wrist strap attaching means, for extending over the back side of the glove at an angle for tightly securing the glove about the subject's hand.

13. The glove of claim 12 wherein said back side includes a substantial section of stretchable material and wherein said back strap attaching means extend thereover at an angle when the back strap attaching means assumes a secured position.

* * * * *